US011542686B2

(12) United States Patent
Mollick

(10) Patent No.: US 11,542,686 B2
(45) Date of Patent: Jan. 3, 2023

(54) SYSTEM FOR MACHINE AND DUAL IMPLEMENT CONTROL

(71) Applicant: Peter Joseph Mollick, Phoenix, AZ (US)

(72) Inventor: Peter Joseph Mollick, Phoenix, AZ (US)

( * ) Notice: Subject to any disclaimer, the term of this patent is extended or adjusted under 35 U.S.C. 154(b) by 322 days.

(21) Appl. No.: 17/096,861

(22) Filed: Nov. 12, 2020

(65) Prior Publication Data

US 2021/0062475 A1 Mar. 4, 2021

Related U.S. Application Data

(62) Division of application No. 16/179,340, filed on Nov. 2, 2018, now Pat. No. 10,858,809.

(60) Provisional application No. 62/762,726, filed on May 18, 2018, provisional application No. 62/762,278, filed on Apr. 27, 2018, provisional application No. 62/709,417, filed on Jan. 19, 2018, provisional application No. 62/707,447, filed on Nov. 3, 2017.

(51) Int. Cl.
*E02F 9/26* (2006.01)
*E02F 9/20* (2006.01)

(52) U.S. Cl.
CPC ..... *E02F 9/265* (2013.01); *E02F 9/205* (2013.01); *E02F 9/2045* (2013.01); *E02F 9/262* (2013.01)

(58) Field of Classification Search
CPC ..... E02F 9/265; E02F 9/262; E02F 9/2045; E02F 9/205
See application file for complete search history.

(56) References Cited

U.S. PATENT DOCUMENTS

| | | | | |
|---|---|---|---|---|
| 10,455,753 | B2 | 10/2019 | Mollick | |
| 2002/1255018 | | 9/2002 | Bernhardt | |
| 2004/0111202 | A1 | 6/2004 | Mailer | |
| 2008/0195268 | A1* | 8/2008 | Sapilewski ..... | A01B 69/004 701/23 |
| 2009/0198382 | A1 | 8/2009 | Koch | |
| 2013/0110358 | A1 | 5/2013 | Merx | |

* cited by examiner

*Primary Examiner* — Peter D Nolan
*Assistant Examiner* — Demetra R Smith-Stewart

(57) ABSTRACT

A system for controlling the lateral traverse position of a front three-point hitch mounted side-shifting implement and a rear three-point hitch mounted side-shifting implement on a mobile machinery such as an agricultural tractor with an controllable automated steering device, while simultaneously controlling the position of the tractor relative to the positions of each of the two side-shifting implements. The system uses a controller to control the positions of the side-shifting-implements using information received from a position monitoring system communication with roving receivers mounted on the side-shifting-implements. The controller also controls the position of the mobile machinery using local relationship sensors mounted on the side-shifting-implement's position and on the mobile machinery's position. The relationship sensors allow the controller to use two roving data receivers instead of three roving data receivers to control both the position of the side shifting implements and the position of the mobile machinery.

20 Claims, 9 Drawing Sheets

SYSTEM FOR MACHINE AND DUAL IMPLEMENT CONTROL

CROSS-REFERENCE TO RELATED APPLICATIONS

This application claims priority to and is a Divisional Application of U.S. patent application Ser. No. 16/179,340 titles "System for Machine and Implement Control," filed Nov. 2, 2018, which claims the benefit of U.S. Provisional Patent Application No. 62/707,447 titled "System for machine and implement control" filed Nov. 3, 2017, U.S. Provisional Patent Application No. 62/762,726 titled "System for machine and implement control," filed May 18, 2018, U.S. Provisional Patent Application No. 62/709,417 titled "System for Connecting Implement to Mobile Machinery," filed Jan. 19, 2018, and U.S. Provisional Patent Application No. 62/762,278 titled "Connector for Mobile Machinery with Support Members," filed Apr. 27, 2018, the contents of which are incorporated herein by reference in their entirety. This application is related to U.S. patent application Ser. No. 15/480,914 filed on Apr. 6, 2017, which is incorporated herein by reference in its entirety, and which claims the benefit of U.S. Provisional Patent Application Ser. No. 62/390,693 titled "Laterally adjustable 3-point hitch attachment device" filed Apr. 7, 2016, and U.S. Provisional Patent Application No. 62/496,424 titled "Laterally adjustable three-point hitch implement apparatus," filed Oct. 18, 2016, the contents of which are incorporated herein by reference in their entirety.

TECHNICAL FIELD

This disclosure is directed to a system and method for controlling the position of a rigidly attached side-shifting-implement mounted on a mobile machinery while also controlling and adjusting the position of the mobile machinery. The system can utilize a position monitoring system with the availability to use different position monitoring techniques such as Global Positioning Systems (GPS), Local Positioning System (LPS), Laser Guidence systems and other relevant systems. In addition, the system utilizes local relationship sensors mounted on the implement and on the mobile machinery, the sensor mounted on the mobile machinery may in the alternative be mounted on a stationary attachment to the mobile machinery which represents the position of the mobile machinery while the sensor mounted on the implement or a position that represents the implement position moves with the implement. This disclosure is not represented of controlling a towed implement that laterally pivots independantly of the position of the mobile machinery.

BACKGROUND

Mobile machinery and attached implements are used in many industries performing various types of work functions, such as in the construction, transportation, excavation and agricultural industries. Current position monitoring systems rely on GPS and laser positioning guidance systems in the excavation and agricultural industries. These position monitoring systems generally involve the use of a signal receiver to receive communication signals from a number of satellites and/or a base station then using at least one controller to direct the position of the implement or the mobile machine or both. Typical to some of these industries are implements with the ability to side-shift its position providing an advantage to the work efficiency of the implement and the mobile machinery. The controller configured to control and adjust the position of the side-shifting-implement in response from information received from a position monitoring system. The controller is the brains of the operation and it encompasses a processor usually measured in bits, for example, a 32 bit processor. The controller may also be combined with a monitor, or provide a data link to a monitor.

Control of the side-shifting-implement and the mobile machinery is normally controlled by a position monitoring system to control the position of the implement and the mobile machine. In the agricultural industry, position monitoring systems are currently utilizing GPS guidence systems to control the steering and position of the mobile machinery tractor using a GPS signal receiver mounted on the tractor and an additional GPS signal receiver mounted on the implement to gauge and adjust the position of the implement. Two GPS receivers allows monitoring and control of the position of the implement and the tractor.

In the excavation field, some motor-graders utilize a side-shifting-implement arrangement to adjust the position of the grading blade in a lateral horizontal plane. Although the position of the motor-grader side-shifting-implement blade can normally be adjusted manually with a valve and lever, in many instances the side-shifting-implement blade and the motor-grader are controlled and positioned using GPS or laser technology or a combination of the both. In these instances, position monitoring receivers with varying degrees of accuracy are placed on both the side-shifting-implement blade and the motor-grader mobile machinery. One example of GPS receivers located on the side-shifting-implement and on a earth moving machine is U.S. Pat. No. 6,655,465 issued to Carlson et al. on Dec. 2, 2003, describes a system and method for the automatic control of a earth moving machine and the side-shifting-implement blade attached to the earth moving machine, claim 2 and claim 11 describing the location of GPS receivers mounted on both the side-shifting-implement blade and also mounted on the earth moving machine.

Using a position monitoring receiver on both the machine and the implement allows the controller to position the mobile machinery independent of the side-shifting-implement. Although this system of position monitoring receivers mounted on the machine and the implement is somewhat effective and currently used extensively in the afore mentioned industries, the accuracy of GPS receivers can be undesirable in some situations. Two receivers interacting in conjunction with each other while comparing measurements can have the effect of doubling a possible measurement error of one receiver when both receivers provide measurements errors. In addition to the possible multiplying effect of measurement errors, the monetary cost of two receivers compared to one receiver can be substantial. Some GPS measurement errors can be reduced but not eliminated entirely. One system to reduce GPS errors is Real-Time Kinematics GPS (RTK-GPS). RTK-GPS uses at least one rover receiver and at least one base station receiver/transmitter with the system providing corrections to the satellite GPS signals the rover receiver utilizes for increased measurment accuracy. Satellite transmitted non-corrected GPS signals are in the range of five meter accuracy, RTK-GPS accuracy claims are in the four to ten centimeter accuracy, although actual field "in use" accuracy may vary from these claims. In addition to accuracy variations, GPS system down time can occur in some instances resulting in a disruption of the GPS signals and a pause in active work in the field. RTK-GPS systems are popular in the agriculture industry.

As mentioned previously, agricultural tractors are currently utilizing side-shifting-implements for precise positioning of implements. Although these side-shifting-implements are relatively new in the mainstream agricultural market place, new devices are seeing improved sales and combined advertising with popular tractor manufacturers guideance systems. One such device is distributed by LaForge Systems in Concord, Calif. 94521, the device is called the Dyna Trac Ultima. This device is a three-point mounted side shifting apparatus designed to attach a variety of implements to.

A purpose of this disclosed invention is directed towards improving the position relationship between the mobile machinery and the attached side-shifting-implement resulting in improved position guidance system accuracy when compared to position guidance systems currently being utilized in industry today.

SUMMARY OF THE INVENTION

In one aspect, the present disclosure is directed to a position monitoring system for automatically controlling and adjusting the lateral traverse position of a side-shifting-implement mounted on a mobile machinery while simultaneously automatically controlling the position of a mobile machinery while both the side-shifting-implement and the mobile machinery follow a predetermined path or in some cases such as turns or other special conditions, separate predetermined paths, and in some instances an autonomous path. Although systems now exist in industry to accomplish this feat, the present disclosed system is a more accurate and effective system for accomplishing this feat in a simpler more effective design. Current position monitoring systems use a separate signal receiver mounted on the side-shifting-implement and a separate signal receiver mounted on the mobile machinery, each signal receiver receiving signals from a satellite or base station transmitter as in GPS or laser style systems with varying degrees of accuracy, these signal receivers attached to the mobile machinery and the implements are called rover signal receivers, as they travel with the mobile machinery and the attached implement. After receiving communications from the satellites and base station for signal corrections, the rover signal receivers then communicates data to a controller for the position adjustments of the side-shifting-implement and the mobile machinery, the controller directing hydraulic fluid valves or other means of controlling the mobile machinery and attached side-shifting-implements. The current systems in the marketplace of using a separate signal receiver for the side-shifting-implement and another separate signal receiver for the mobile machinery is somewhat cumbersome and could be compared to using two steering wheels steering in unison to control the two front wheels of a automobile, this configuration would be cumbersome and inefficient. The proper configuration for automobile front wheels is one steering wheel controlling attached linkage compelling one wheel to position itself in unison with the other wheel, this arrangement requiring less parts and more accuracy than a two steering wheel design. The present disclosure fits this proper configuration comparison whereas a signal receiver is mounted on the side-shifting-implement and then the position of the mobile machinery in relation to the position of the side-shifting-implement is measured using relationship sensors acting as the linkage for the mobile machinery and the implement while the controller controls the position between the two to keep them moving in unison while making adjustments to each others position when required. The relationship sensors replace the second signal receiver normally mounted on the mobile machinery, achieving this by providing information to the controller enabling the controller to position the mobile machinery in relation to the side-shifting-implement. Measurement errors using relationship sensors are almost non existent. Usually, the first priority while work is being performed with a mobile machine and an attached implement is the monitoring and positioning of the implement while the position of the mobile machinery is usually second in priority. The present disclosure is a more accurate and cost effective system than the current double rover signal receiver systems available in the marketplace today. The disclosed mobile machinery and side-shifting-implement mounted relationship sensors are an accurate and simple measurement configuration for measuring the positions of the side-shifting-implement in relation to the mobile machinery, resulting in an improved position monitoring system resulting in an improvement of the work being performed.

In another aspect, the present disclosure is directed at the ease of operational use of the relationship sensors measuring the position relationship between the mobile machinery and the side-shifting-implement. If the mobile machinery is used in a non robotic application with a machine operator on board, switching from an automatically controlled position system to an assisted controlled position system that allows the machine operator to view a screen displaying the position relationship between the mobile machinery and the side-shifting-implement easily without the use of an expensive viewing monitor. The mobile machinery position relative to the side-shifting-implement position is easily displayed and viewable as the sensors react with each other. As the machine operator views the sensor display screen, the machine operator can easily perform any needed adjustments between the mobile machinery and the side-shifting-implement as required as in the example of manually attaching or detaching an implement to or from the mobile machinery.

DRAWINGS

A better understanding of the present invention will be had upon reference to the following description in conjunction with the accompanying drawings in which like numerals refer to like parts throughout the views wherein:

FIG. 1*a* is a side elevation view showing a prior art agricultural tractor with a non-side-shifting weeder implement mounted to the rear three-point hitch of the tractor. Also showing the position monitoring system accessories mounted to the tractor utilizing GPS receivers mounted on the implement and and the current common use of a GPS receiver mounted on the tractor cab.

FIG. 1*b* is a side elevation view showing a prior art agricultural tractor with a non-side-shifting weeder implement mounted to the front and rear three-point hitches of the tractor. Also showing the position monitoring system accessories mounted to the tractor utilizing GPS receivers mounted on the implements and the current common use of a GPS receiver mounted on the tractor cab.

FIG. 2*a* is a side elevation view showing a prior art agricultural tractor with a prior art side-shifting-implement attachment apparatus (Mollick U.S. patent application Ser. No. 15/480,914) with a weeder implement attached, both mounted to the rear three-point hitch of a tractor. Also showing prior art position monitoring system accessories mounted to the tractor utilizing GPS receivers mounted on the implement and a GPS receiver mounted on the tractor cab.

FIG. 2*b* is a side elevation view showing a agricultural tractor similar to that of FIG. 2*a* with a side-shifting-implement attachment apparatus with a weeder implement attached, both mounted to the rear three-point hitch of a tractor. Also showing the disclosed invention with the position monitoring system accessories mounted to the tractor utilizing a GPS receiver mounted on the implement and no GPS receiver mounted on the tractor cab, cab mounted GPS receiver replaced by relationship sensors mounted on the side-shifting-implement attachment apparatus, sensors used to guide the tractor position.

FIG. 3*a* is a side elevation view showing a prior art agricultural tractor with a side-shifting-implement attachment apparatus with a weeder implement attached, both mounted to the front and rear three-point hitches of a tractor. Also showing the prior art position monitoring system accessories mounted to the tractor utilizing GPS receivers mounted on the front and rear implements and a GPS receiver mounted on the tractor cab.

FIG. 3*b* is a side elevation view showing a agricultural tractor with a two side-shifting-implement attachment apparatuses with weeder implements attached, both mounted to the front and rear three-point hitches of a tractor. Also showing the disclosed position monitoring system accessories mounted to the tractor utilizing GPS receivers mounted on the front and rear implements and no GPS receiver mounted on the tractor cab, cab mounted GPS receiver replaced by relationship sensors to guide the tractor position.

FIG. 4*a* is a side elevation view schematically showing a prior art excavating motor-grader with a side-shifting-implement blade apparatus. Also showing the prior art position monitoring system accessories mounted to the motor-grader utilizing GPS a receiver mounted on the side-shifting-blade and a GPS receiver mounted on the tractor cab.

FIG. 4*b* is a side elevation view showing an excavating motor-grader with a side-shifting-implement blade apparatus. Also showing the disclosed invention with the position monitoring system accessories mounted to the motor-grader utilizing a GPS receiver mounted on the implement blade and no GPS receiver mounted on the motor-grader cab, cab mounted GPS receiver replaced by relationship sensors to guide the motor-grader position.

Figure 8A:
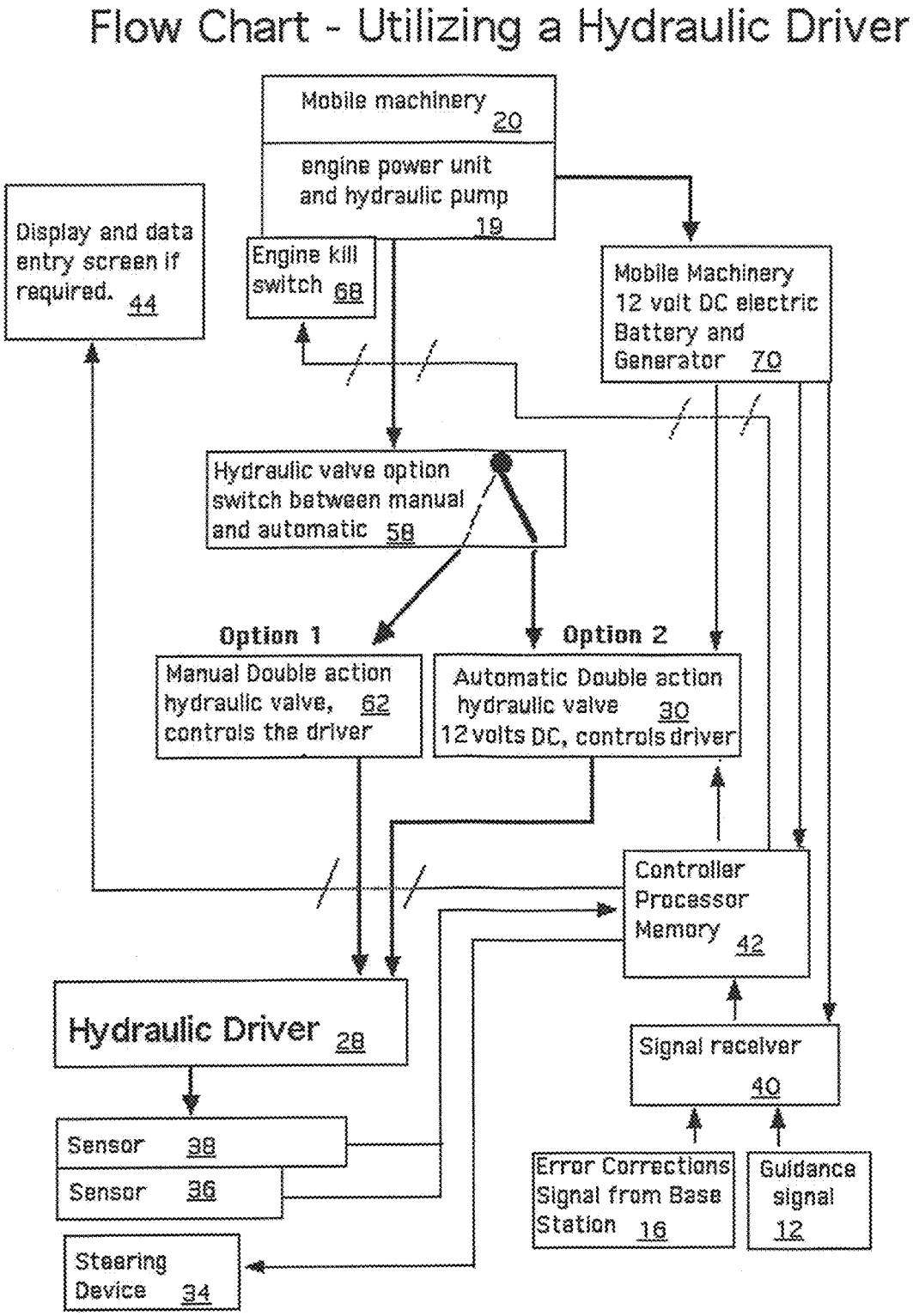

FIG. 8*a* is a flow chart depicting a hydraulic driver and related components suitable for use with the present invention.

Figure 8B:
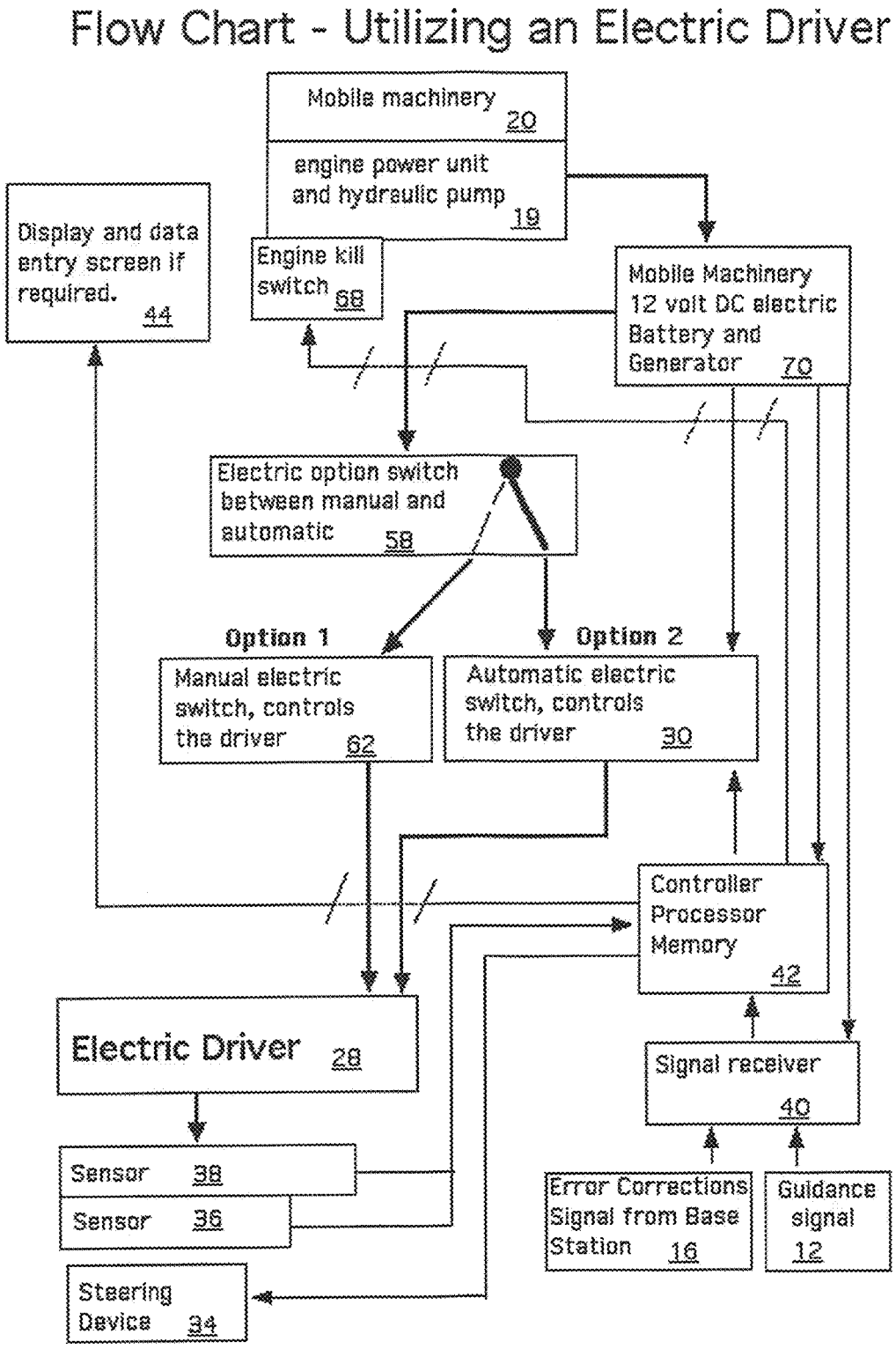

FIG. 8*b* is a flow chart depicting an electric driver and related components of the present invention apparatuses.

DESCRIPTION OF REFERENCE NUMERALS

For the convenience of the reader, the following is a list of reference numbers used description.

8 Position monitoring system.
10 GPS satellite, regular.
12 Guidance signal, GPS, LPS, laser or other.
14 Base station with receiver and transmitter.
16 Base station error correction signal.
18 Base station transmitting antenna.
19 Mobile machinery power supply.
20 Mobile machinery, Agricultural tractor.
21 Mobile machinery, Motor-grader.
22 Three point hitch, bottom and top link arms, rear mounted
22*a* Three point hitch, bottom and top link arms, front mounted
24 empty
25 Excavating blade
26 Side-shifting-implement attachment device, rear. (Mollick U.S. patent application Ser. No. 15/480,914)
26*a* Side-shifting-implement attachment device, front. (Mollick U.S. patent application Ser. No. 15/480,914)
27 Side-shifting-implement frame assembly.
28 side-shifting-implement driver, rear.
28*a* side-shifting-implement driver, front.
30 side-shifting-implement driver control device, rear.
30*a* side-shifting-implement driver control device, front.
31 Side-shifting-implement attachment device sliding frame. (Second Frame)
32 Side-shifting-implement attachment device rigid mounted frame. (First Frame) (acting as an extension of the mobile machinery)
33 Implement, rear mounted
33*a* Implement, front mounted
33*b* Implement, towed
34 Steering control device.
36 Sensor mounted on side-shifting-implement attachment device sliding frame, rear.
36*a* Sensor mounted on side-shifting-implement attachment device sliding frame, front.
38 Sensor mounted on side-shifting-implement attachment device rigid mounted frame, rear. (number 32 acts as an extension of the mobile machinery)
38*a* Sensor mounted on side-shifting-implement attachment device rigid mounted frame, front. (number 32 acts as an extension of the mobile machinery)
40 Receiver, rover, implement mounted, rear.
40*a* Receiver, rover, implement mounted, front.
41 Receiver, rover, mobile machinery mounted.
42 Controller with processor.
44 Display monitor with data entry capabilities.
45 Signal, controller to machine rooftop receiver.
46 Signal, controller to implement receiver, rear.
46*a* Signal, controller to implement receiver, front.
48 Signal, controller to monitor.
50 Signal, controller to steering control device.
52 Signal, controller to sensors, rear.
52*a* Signal, controller to sensors, front.
54 Signal, controller to driver control device.
56 Signal or hydraulic fluid signal, driver control device to driver.
58 Switch, auto to manual for implement driver position.
60 Switch, auto to manual for mobile machinery steering.
62 Manual control device, driver operation.
70 Battery and Generator on mobile machinery.
72 Signal Transmitter
74 Signal receiver
76 Towing coupling
78 Towing attachment clamp

DESCRIPTION

Figure 1A:
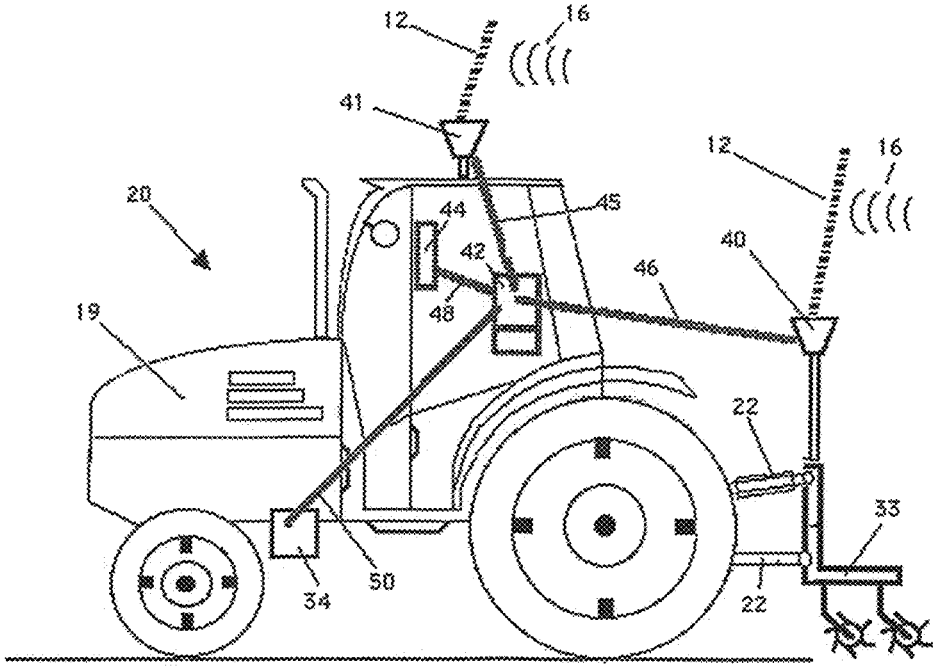
FIG. 1a Prior Art

FIG. 1*a* shows a side elevation of a prior art agricultural tractor 20 with one non-side-shifting weeder implement 33 mounted to the rear three-point hitch 22 of the tractor. In the agricultural industry, this setup is common in the operation of the agricultural tractor 20 with an attached implements 33. GPS guidance of the tractor to properly position the implement 33 on a predetermined or non predetermined path is the normal method of farming in many of todays larger farms. A power supply 19 provides power for the tractor 20 and the position monitoring system 8. The controller 42 being the brains of the operation receives a guidance signal 12 and error correction signals 16 from the tractor rooftop mounted receiver 41 to position and steer the tractor 20 using a steering device 34 in order to position the attached implement 33 on its own path, although this can be a difficult task considering the implement 33 is not steerable on its own and must rely on the tractor 20 position. The implement 33 position being rearwardly mounted on the tractor 20 causes the implement 33 to pitch to the left when the tractor 20 is steered to the right and vice versa further aggravating an out of position situation for an implement 33. In this prior art scenario, the tractor 20 position controls the position of the implement 33. The position of the implement 33 is monitored using the receiver 40 receiving guidance signals 12 from the satellites 10 (see FIG. 5) and error correction signals 16 from a base receiver station 14 (see FIG. 5). Controller 42 uses data received from receiver 41 and receiver 40 to determine the position adjustments needed to place the tractor 20 and therefore the implement 33 on the proper path. Display monitor with data entry capabilities 44 allows for data entry to direct the contriller 42. Controller communicates with the receiver 41 using a wired or wireless signal 45. Controller communicates with the receiver 40 using a wired or wireless signal 46. Controller communicates with the display monitor 44 using a wired or wireless signal 48. Controller communicates with the steering device 34 using a wired or wireless signal 50.

Figure 1B:
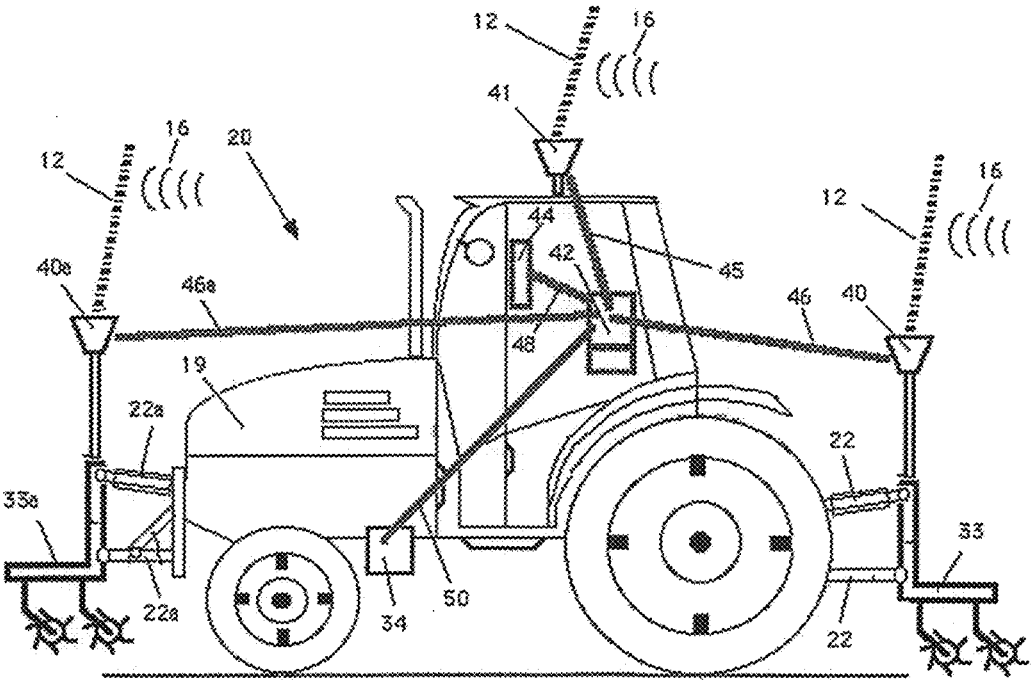
FIG. 1b Prior Art

FIG. 1*b* shows a side elevation of a prior art agricultural tractor 20 with one implement 33 mounted to the rear three-point hitch 22 of the tractor and one implement 33*a* mounted to the front three-point hitch 22*a* of the tractor. This double implement attachment arrangement with one implement 33*a* mounted on the front three-point hitch 22*a* and another implement 33 mounted on the rear three-point hitch 22 adds increased production to the tractors 20 pass through the farm field resulting in the opportunity of twice the work performed compared to a single implement mounted on either the front or rear three-point hitch. The position of each implement 33 or 33*a* will depend on the position of the tractor 20 as the tractor 20 steers through the farm field. Controller 42 will monitor the position of the tractor 20 using receiver 41 and also monitor the position of the implement 33*a* at the front of the tractor and the position of the implement 33 at the rear of the tractor 20 using the front receiver 40*a* and the rear receiver 40 in order to compare positions and make adjustments as needed. The front and rear three-point implements 33 and 33*a* attached to the tractor increases the complexity of the tractor 20 position requirements to correctly position the implements 33 and 33*a* on the correct predetermined or non predetermined paths. The complexity of positioning implement 33 and implement 33*a* on a tractor 20 not utilizing a side-shifting-implement attachment device 26 (see FIG. 2*a*) configuration may cause the implements to be out of position while the tractor is in the mode of repositioning itself when required.

Figure 2A:
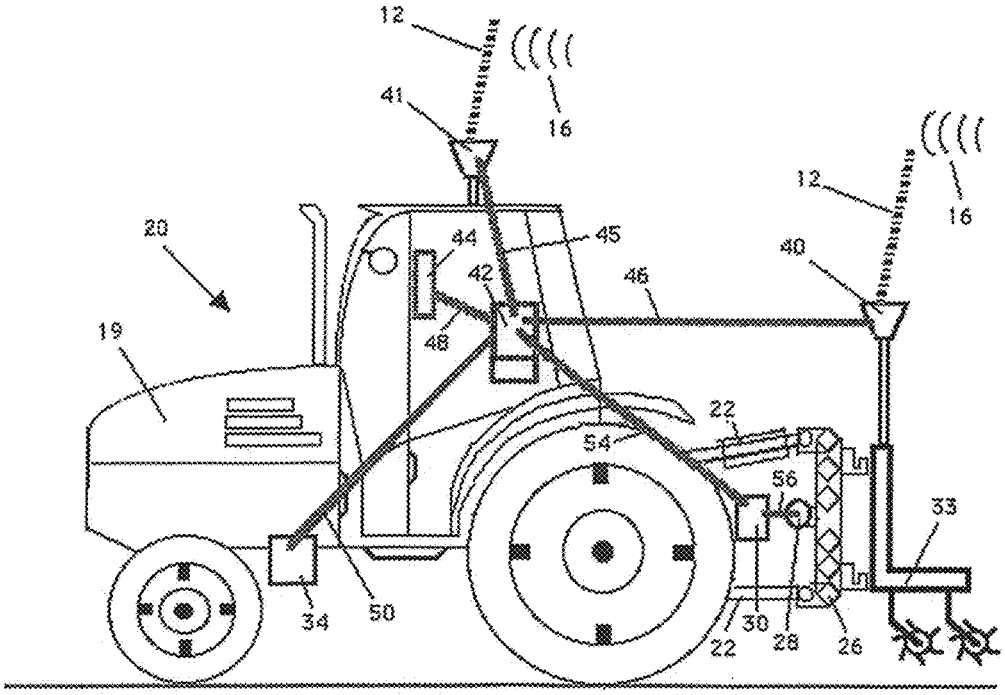
FIG. 2a Prior Art

FIG. 2*a* shows a side elevation of a prior art agricultural tractor 20 with a side-shifting-implement attachment device 26 mounted to the rear three-point hitch 22 and one implement 33 mounted to the side-shifting-implement attachment device 26. This side-shifting configuration allows the implement 33 to partially steer itself with limited motion on a predetermined or non predetermined path using receiver 40 while the tractor 20 also steers itself on the correct path using receiver 41. The side-shifting-implement attachment device 26 uses a driver 28 to move the side-shifting-implement attachment device sliding frame 31 (see FIG. 7), therefore repositioning the implement 33 as required. The side-shifting-implement attachment device rigid mounted frame 32 (see FIG. 7) is mounted to the tractor 20 rear three-point hitch 22 and acts as an extension of the tractor 20. Controller 42 using the wired or wireless signal 54 to activate the driver control device 30 to to send a wired or wireless signal or hydraulic fluid signal 56 to the driver 28 consequently moving the driver 28 and the implement 33. This above mentioned prior art configuration is an advantage over the prior art configuration mentioned in FIG. 1*a* by allowing the implement 33 to maintain its correct path in a limited movement space uninterrupted by the tractor 20 incorrect position as directed by possible errors of the guidance signal 12 and possible errors of the error correction signals 16 from a base receiver station 14 (see FIG. 5). In the event the tractor 20 position is out of position to a large degree due to a guidance 12 or receiver 41 failure, the side-shifting-implement attachment device 26 will be out of the limited range of motion to keep the implement 33 on its correct path and implement 33 will move away from its correct path while following the tractor 20 incorrect position. This prior art configuration in FIG. 2*a* using the receiver 41 mounted on the tractor 20 and the receiver 40 mounted on the implement 33 relies on both receiver 41 and receiver 40 to be functional and accurate at all times to keep the implement 33 on the correct path as the implement 33 position generally follows the tractor 20 position. The tractor 20 position is controlled by the controller 42 communicating with the receiver 41 mounted on the tractor then sending a signal 50 to the steering control device 34 to steer and position the tractor 20.

Figure 2B:
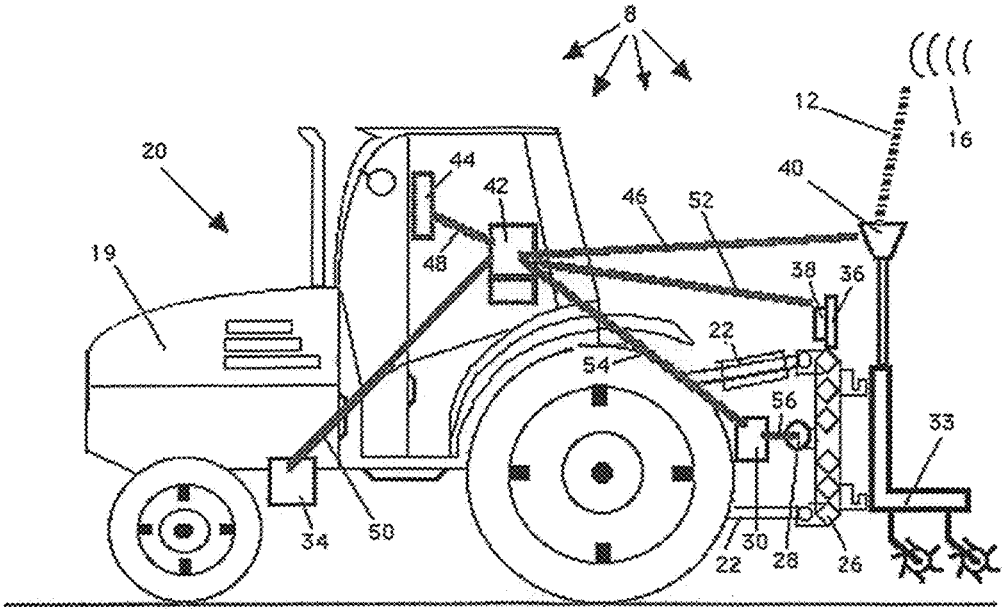

FIG. 2*b* shows the disclosed invention while viewing the side elevation of an agricultural tractor 20 similar to FIG. 2*a*. The differences between FIG. 2*a* and FIG. 2*b* comprising the following alterations to FIG. 2*a:* a) The addition of relationship sensors 36 and 38 to the rear side-shifting-implement attachment device 26; (Also disclosed in Mollick U.S. patent application Ser. No. 15/480,914).

b) The addition of the signal 52 in a wired or wireless configuration from the controller to the rear sensors 36 and 38; (Also disclosed in Mollick U.S. patent application Ser. No. 15/480,914).

c) The removal of the receiver 41 and the removal of the signal 45 wire or wireless connection;

d) The addition of a reconfigured controller 42 capable of the new data processing scheme to include the additional rear sensors 36 and 38; and (Also disclosed in Mollick U.S. patent application Ser. No. 15/480,914).

e) Controller eliminating the need of the receiver 41 in the operation of the tractor and implement positions. (Also disclosed in Mollick U.S. patent application Ser. No. 15/480,914).

FIG. 2*b* also showing the following improvements on FIG. 2*a*; the disclosed system and method with an improved implement 33 and tractor 20 path tracking and positioning monitoring system 8 allowing for the use of receiver 40 on the rear implement 33 and no receiver 41 (see FIG. 2*a*), required to be mounted on the tractor 20. Showing sensor 36 and sensor 38 located on the rear side-shifting-implement attachment device 26. Sensor 36 mounted on the side-shifting-implement attachment device sliding frame 31 (see FIG. 7), sensor 38 mounted on the side-shifting-implement attachment device rigid mounted frame 32 (see FIG. 7) attached to the tractor 20 rear three-point hitch 22. The interaction of the sensors 36 and 38 creates a position relationship between the sensors consequently reflecting the position relationship of the corresponding implement 33 and the tractor 20, the sensor position relationship is communicated to controller 42 through the wired or wireless signal 52. The controller 42 receives information from sensors 36 and 38 to measure the position of the implement 33 as compared to the position of the tractor 20 while also receiving information from receiver 40, then controller 42 controls the steering of the tractor 20 by sending a signal through the wired or wireless signal 50 to the tractor 20 steering control device 34 to control the position of the tractor 20 without the requirement of a tractor 20 mounted GPS or other signal receiver receiving external data signals, tractor 20 position relying on the controller 42 communicating with the implement mounted receivers 40 and the sensors 36 and 38. The tractor 20 position normally programmed to align center on center with the implements 33, although offset alignments are possible. Controller 42 using the wired or wireless signal 54 to activate the driver control device 30 to to send a wired or wireless signal or hydraulic fluid signal 56 to the driver 28 consequently moving the driver 28 and the implement 33. Showing a display monitor 44, signal 48 to controller, a power supply 19 provides power for the tractor 20 and the position monitoring system 8. This new disclosed system and method of controlling the position of the tractor 20 as related to the position of the implement 33 is very accurate and dependable as the sensors 36 and 38 are locally communicating with the controller 42 without depending on equipment mounted in an area far away from the tractor 20 and the implement 33. The accuracy of the sensors 36 and 38 are an improvement over the accuracy of GPS guidance signals 12 even when error correction signals 16 from a base station receiver and transmitter 14 (see FIG. 5) are applied. Consequently, implement 33 is positioned by a GPS or other external signal 12 and optionally with error corrections applied 16, then the tractor 20 is positioned using the relationship between sensors 36 and 38 ultimately enabling the tractor 20 position to follow the implement 33 position converse and superior to the prior art as shown in FIG. 2*a* where the side-shifting-implement attachment device 26 and implement 33 position follows the tractor 20 position.

Figure 3A:
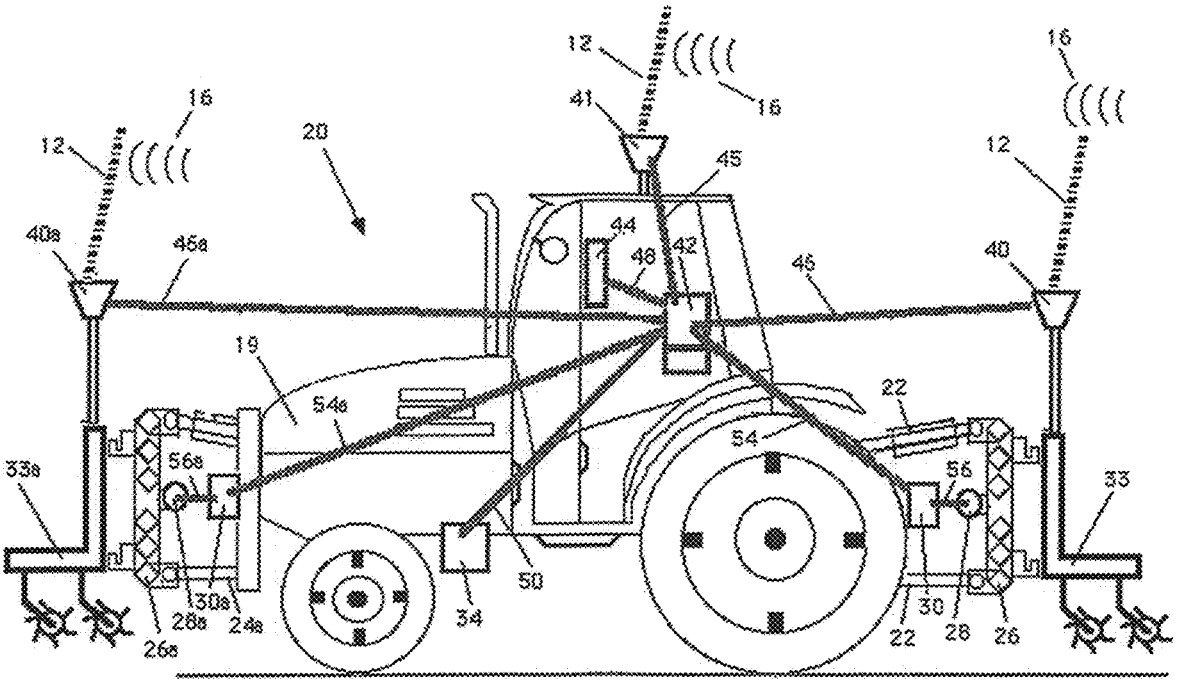
FIG. 3a Prior Art

FIG. 3*a* shows a side elevation of a prior art agricultural tractor 20 as shown in FIG. 2*a* with the addition of a prior art side-shifting-implement attachment device 26*a* mounted to the front three-point hitch 22*a* and implement 33*a* mounted to the side-shifting-implement attachment device 26*a*. The configuration demonstrating a prior art front three-point hitch 22*a* and a prior art rear three-point hitch 22 combined with a prior art front side-shifting-implement attachment device 26*a* with attached implement 33*a* and a prior art rear side-shifting-implement attachment device 26 with attached implement 33. The front side-shifting-implement attachment device 26*a* uses a driver 28*a* to move the Side-shifting-implement attachment device sliding frame 31 (see FIG. 7), therefore repositioning the implement 33*a* as required. The side-shifting-implement attachment device rigid mounted frame 32 (see FIG. 7) is mounted to the tractor 20 front three-point hitch 22*a* and acts as an extension of the tractor 20. Controller 42 using the front wired or wireless signal 54*a* to activate the driver control device 30*a* to to send a wired or wireless signal or or hydraulic fluid signal 56*a* to the driver 28*a* consequently moving the driver 28*a* and the front implement 33*a*. The controller 42 communicates with receiver 41 to monitor and adjust the tractor 20 position. The controller 42 also communicates with the front receiver 40*a* and the rear receiver 40 to determine the front implement 33*a* position and the rear implement 33 position and adjust each implement position to a correct path. The controller 42 may choose or alter the tractor 20 position by communicating between receiver 40*a* front and receiver 40 rear locations utilizing signal 46 and 46*a* and must also communicate with the tractor mounted receiver 41 to determine the tractor 20 position in relation to the front and rear implements positions 33 and 33*a* and then adjust accordingly. The prior art configuration in this FIG. 3*a* using the receiver 41 mounted on the tractor and receiver 40 and 40*a* mounted on the implement 33 and implement 33*a* relies on receiver 40, receiver 40*a* and receiver 41 to be functional and accurate at all times to keep the implements 33 and 33*a* on the correct path as they follow the tractor 20 position. The tractor 20 position is controlled by the controller 42 communicating with the receiver 41 mounted on the tractor then sending a signal 50 to the steering control device 34 to steer and position the tractor 20.

Figure 3B:
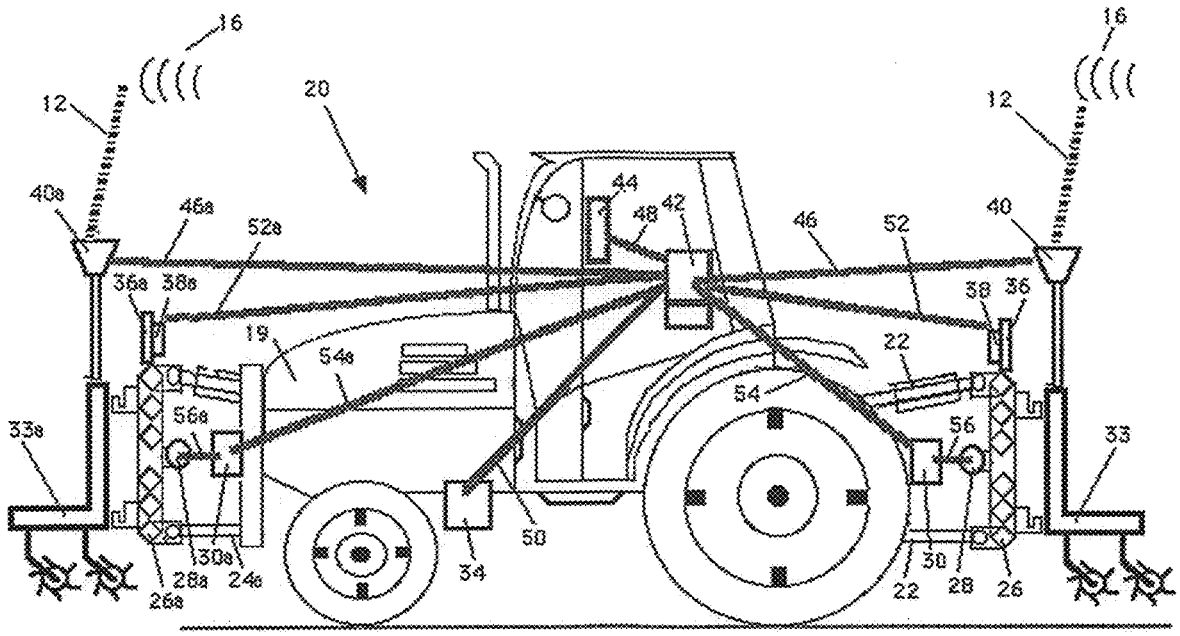

FIG. 3*b* shows the disclosed invention while viewing the side elevation of an agricultural tractor 20 similar to FIG. 3*a*. The differences between FIG. 3*a* and FIG. 3*b* comprising the following alterations to FIG. 3*a:*

The addition of relationship sensors 36 and 38 to the rear side-shifting-implement attachment device 26; (Also disclosed in Mollick U.S. patent application Ser. No. 15/480,914).

The addition of relationship sensors 36*a* and 38*a* to the front side-shifting-implement attachment device 26*a*; (Also disclosed in Mollick U.S. patent application Ser. No. 15/480,914).

f) The addition of the signal 52 in a wired or wireless configuration from the controller to the rear sensors 36 and 38; (Also disclosed in Mollick U.S. patent application Ser. No. 15/480,914).

g) The addition of the signal 52*a* in a wired or wireless configuration from the controller to the front sensors 36*a* and 38*a*; (Also disclosed in Mollick U.S. patent application Ser. No. 15/480,914).

h) The removal of the receiver 41 and the removal of the signal 45 wire or wireless connection;

i) The addition of a reconfigured controller 42 capable of the new data processing scheme to include the additional front and rear sensors 36, 38, 36*a* and 38*a*; and (Also disclosed in Mollick U.S. patent application Ser. No. 15/480,914).

j) Controller eliminating the need of the receiver 41 in the operation of the tractor and implement positions. (Also disclosed in Mollick U.S. patent application Ser. No. 15/480,914).

FIG. 3*b* also showing the following improvements on FIG. 3*a*, the disclosed system and method with an improved implement 33 and tractor 20 path tracking and positioning monitoring system allowing for the use of receiver 40 on the rear implement 33 and receiver 40*a* on the front implement 33*a* and no receiver 41 required to be mounted on the tractor 20. Showing sensor 36 and sensor 38 located on the rear side-shifting-implement attachment device 26. Sensor 36 mounted on the side-shifting-implement attachment device sliding frame 31 (see FIG. 7), sensor 38 mounted on the side-shifting-implement attachment device rigid mounted frame 32 (see FIG. 7) attached to the tractor 20 rear three-point hitch 22. The interaction of the sensors 36 and 38 creates a position relationship between the sensors consequently reflecting the position relationship of the corresponding implements 33 and 33*a* and the tractor 20, the sensor position relationship is communicated to controller 42 through the wired or wireless signal 52. The aforementioned sensor scenario also applies to the front three-point hitch 22*a* involving items 36*a*, 38*a*, 52*a*, 31*a* and 32*a*. The controller 42 receives information from sensors 36 and 38, 36*a* and 38*a* to measure the position of the implements 33 and 33*a* as compared to the position of the tractor 20 while also receiving information from receiver 40 and receiver 40*a*, then controller 42 controls the steering of the tractor 20 by sending a signal through the wired or wireless signal 50 to the tractor 20 steering control device 34 to control the position of the tractor 20 without the requirement of a tractor mounted GPS or other signal receiver receiving external data signals, tractor 20 position relying on the controller 42 communicating with the implement mounted receivers 40 and 40*a* and the sensors 36 and 38 and sensors 36*a* and 38*a*. The tractor 20 position normally programmed to align center on center with the implements 33 and 33*a*, although offset alignments are available. Controller 42 using the wired or wireless signal 54 and 54*a* to activate the driver control device 30 and 30*a* to to send a wired or wireless signal or hydraulic fluid signal 56 and 56*a* to the driver 28 and 28*a* consequently moving the driver 28 and 28*a* and the implement 33 and 33*a*. This new disclosed system and method of controlling the position of the tractor 20 as related to the position of the implements 33 and 33*a* is very accurate and dependable as the sensors 36 and 38 and sensors 36*a* and 38*a* are locally communicating with the controller 42 without depending on equipment mounted in an area far away from the tractor 20 and the implement 33 and 33*a*. The accuracy of the sensors 36 and 38 and sensors 36*a* and 38*a* are an improvement over the accuracy of GPS signals 12 even when error correction signals 16 from a base station receiver and transmitter 14 (see FIG. 5) are applied. Consequently, implements 33 and 33*a* are positioned by a GPS or other external guidance signal 12 and optionally with error corrections 16 applied, then the tractor 20 is positioned using the relationship between sensors 36 and 38 and sensors 36*a* and 38*a* ultimately enabling the tractor 20 position to follow the implement 33 and 33*a* positions converse and superior to the prior art as shown in FIG. 3*a* where the side-shifting-implement attachment device 26 and 26*a* and implements 33 and 33*a* follow the tractor 20 position.

Figure 4A:
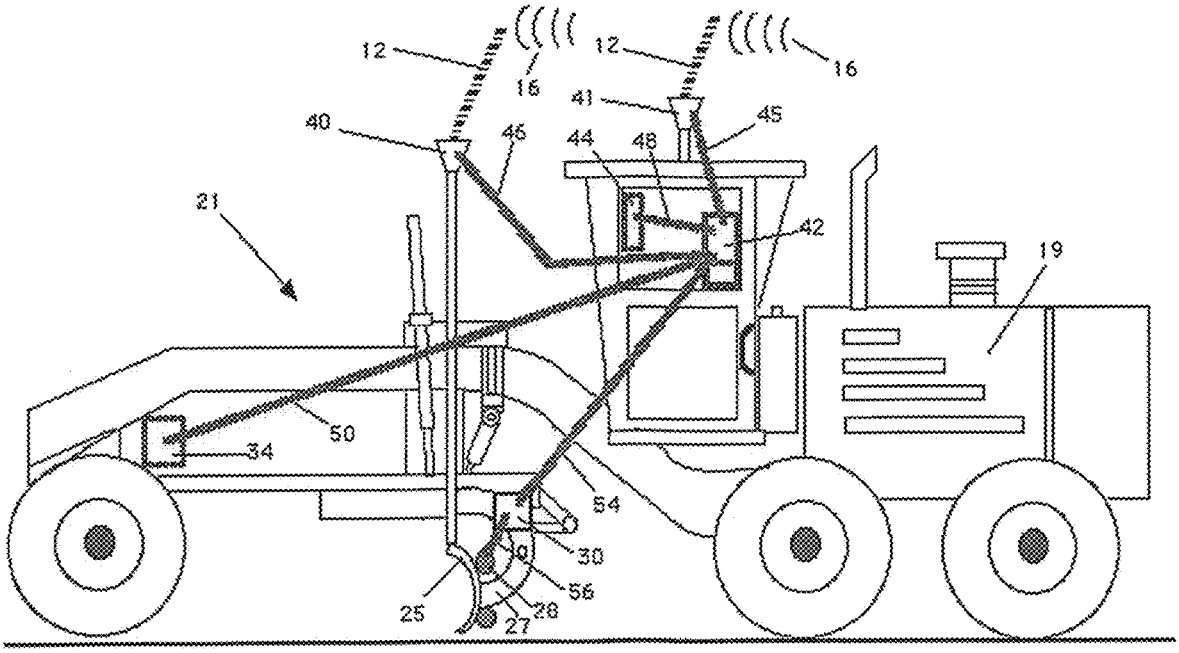
FIG. 4a Prior Art

FIG. 4*a* showing a side elevation view schematically showing a prior art excavating motor-grader 21 with a prior art side-shifting-implement frame assembly 27 with attached excavating blade 25. Prior art FIG. 4*a* operations are the same as prior art FIG. 2*a* except for the position of the side-shifting-frame assembly 27, implement blade 25 and receiver 40, these items are now in the center area of the machine instead of the rear of the machine. Also showing is the prior art position monitoring system accessories mounted to the motor-grader utilizing a controller 42 and display monitor 44 with signal 48 connecting between, Controller 42 receiving positioning signals from motor-grader 21 cab mounted receiver 41 through signal wired or wireless signal 45 and also receiving positioning signs from receiver 40 mounted on the side-shifting-blade. Controller programmed to adjust the position of the motor-grader 21 steering and position using the steering control device 34 utilizing signal 50 wired or wireless connection. Receiver 40 and receiver 41 receives GPS guidance signals 12 from the satellites 10 (see FIG. 5), and error correction signals 16 from a base receiver station 14 (see FIG. 5). The side-shifting configuration allows the blade 25 to partially steer itself with limited motion on a predetermined or non predetermined path using receiver 40 while the motor-grader 21 also steers itself on the correct path using receiver 41. The side-shifting-implement frame assembly 27 uses a driver 28 to move the side-shifting-implement frame assembly 27 therefore repositioning the blade 25 as required. Controller 42 using the wired or wireless signal 54 to activate the driver control device 30 to to send a wired or wireless signal or hydraulic fluid signal 56 to the driver 28 consequently moving the driver 28 and the blade 25. In the event the motor-grader 21 position is out of position to a large degree due to a guidance signal 12 or receiver 41 failure, side-shifting-implement frame assembly 27 will be out of the limited range of motion to keep the blade 25 on its correct path and blade 25 will move away from its correct path while following the motor-grader 21 incorrect position. This prior art configuration in FIG. 4*a* using the receiver 41 mounted on the motor-grader 21 and the receiver 40 mounted on the blade 25 relies on both receiver 41 and receiver 40 to be functional and accurate at all times to keep the blade 25 on the correct path as the blade 25 position generally follows the motor-grader 21 position. The motor-grader 21 position is controlled by the controller 42 communicating with the receiver 41 mounted on the motor-grader 21 then sending a signal 50 to the steering control device 34 to steer and position the motor-grader 21.

Figure 4B:
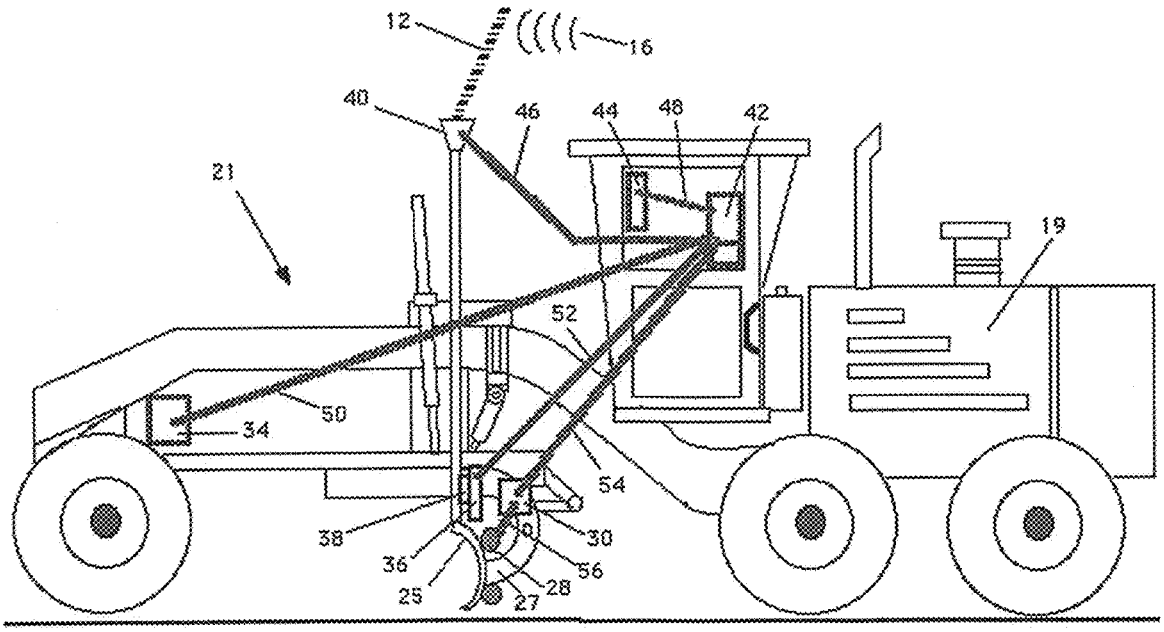

FIG. 4*b* shows the disclosed invention while viewing the side elevation of a motor-grader similar to FIG. 4*a*. The differences between FIG. 4*a* and FIG. 4*b* comprising the following alterations to FIG. 4*a:* a) The addition of relationship sensors 36 and 38 to the side-shifting-implement frame assembly 27 and side shifting implement 25; (Also disclosed in Mollick U.S. patent application Ser. No. 15/480,914).
b) The addition of the signal 52 in a wired or wireless configuration from the controller to the sensors 36 and 38; (Also disclosed in Mollick U.S. patent application Ser. No. 15/480,914).
c) The removal of the receiver 41 and the removal of the signal 45 wire or wireless connection;
d) The addition of a reconfigured controller 42 capable of the new data processing scheme to include the additional sensors 36 and 38; and (Also disclosed in Mollick U.S. patent application Ser. No. 15/480,914).
e) Controller eliminating the need of the receiver 41 in the operation of the motor-grader and implement positions. (Also disclosed in Mollick U.S. patent application Ser. No. 15/480,914).

FIG. 4*b* also showing the following improvements on FIG. 4*a*; the disclosed system and method with an improved implement and motor-grader 21 path tracking and positioning monitoring system allowing for the use of receiver 40 on the blade 25 and no receiver 41 required to be mounted on the motor-grader 21. Showing sensor 36 and sensor 38 located on the side-shifting-implement frame assembly 27 and implement blade 25. Sensor 36 mounted on the side-shifting-implement blade 25, sensor 38 mounted on Side-shifting-implement frame assembly 27 rigidly mounted to the motor-grader 21. The interaction of the sensors 36 and 38 creates a position relationship between the sensors consequently reflecting the position relationship of the corresponding blade 25 and the motor-grader 21, the sensor position relationship is communicated to controller 42 through the wired or wireless signal 52. The controller 42 receives information from sensors 36 and 38 to measure the position of the blade 25 as compared to the position of the motor-grader 21 while also receiving information from receiver 40, then controller 42 controls the steering of the motor-grader 21 by sending a signal through the wired or wireless signal 50 to the motor-grader 21 steering control device 34 to control the position of the motor-grader 21 without the requirement of a motor-grader mounted GPS or other signal receiver receiving external data signals, motor-grader 21 position relying on the controller 42 communicating with the implement mounted receivers 40 and the sensors 36 and 38. The motor-grader 21 position can be programmed to align center on center with the blade 25, or offset alignments are available. A power supply 19 provides power for the motor-grader 21 and the position monitoring system 8. This new disclosed system and method of controlling the position of the motor-grader 21 as related to the position of the blade 25 is very accurate and dependable as the sensors 36 and 38 are locally communicating with the controller 42 without depending on equipment mounted in an area far away from the motor-grader 21 and the blade 25. The accuracy of the sensors 36 and 38 are an improvement over the accuracy of guidance signals 12 even when error correction signals 16 from a base station receiver and transmitter 14 (see FIG. 5) are applied. Consequently, blade 25 is positioned by a GPS or other external guidance signal 12 and optionally with error corrections applied 16, then the motor-grader 21 is positioned using the relationship between sensors 36 and 38 ultimately enabling the motor-grader 21 position to follow the blade 25 position converse and superior to the prior art as shown in FIG. 2*a* where the blade 25 position follows the motor-grader 21 position.

Figure 5:
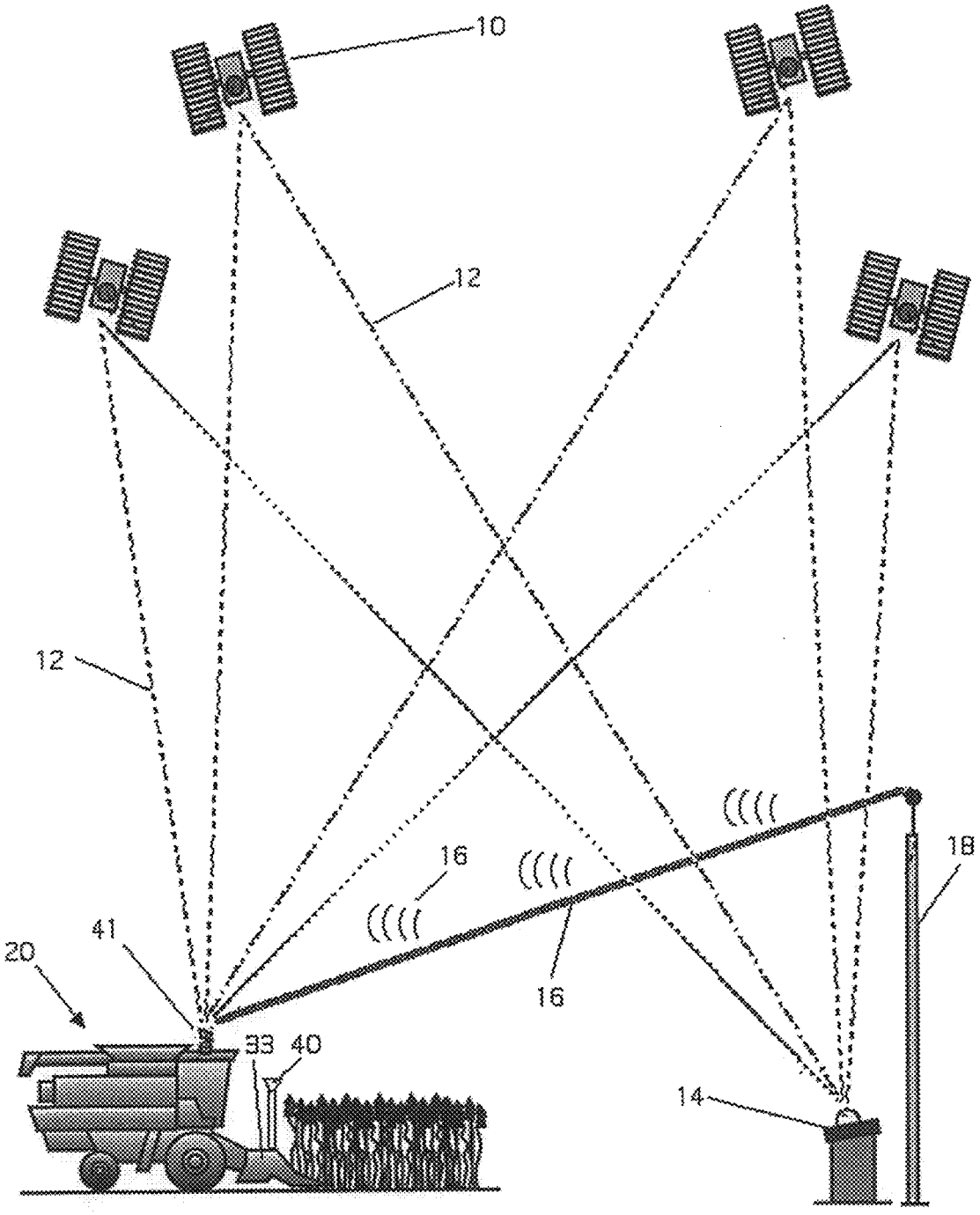
FIG. 5 Prior art
FIG. 5 is a side elevation view showing a typical landscape of a GPS satellite system, base station receiver and rover receiver as operational in a farming environment.

FIG. 5 depicts a prior art drawing of a GPS satellite arrangement in the atmosphere and related GPS signal receiving and transmitting equipment on the earth. The system shown is an example of a Real-Time Kinematics GPS (RTK-GPS) system. Regular GPS satellite 10 is positioned at approximately 11,000 nautical miles in altitude. GPSs satellite signal 12 is received by the mobile machinery 20 mounted rover GPS receiver 41 and the GPS base station 14. GPS base station 14 includes a receiver and transmitter in addition to the transmitting antenna 18. GPS signal error correction signals 16 are transmitted from the GPS base station 14 transmitting antenna 18 to the mobile machinery 20 rover GPS receiver 41. Also shown is a plant harvesting implement 33 and an implement mounted signal receiver 40.

Figure 6:
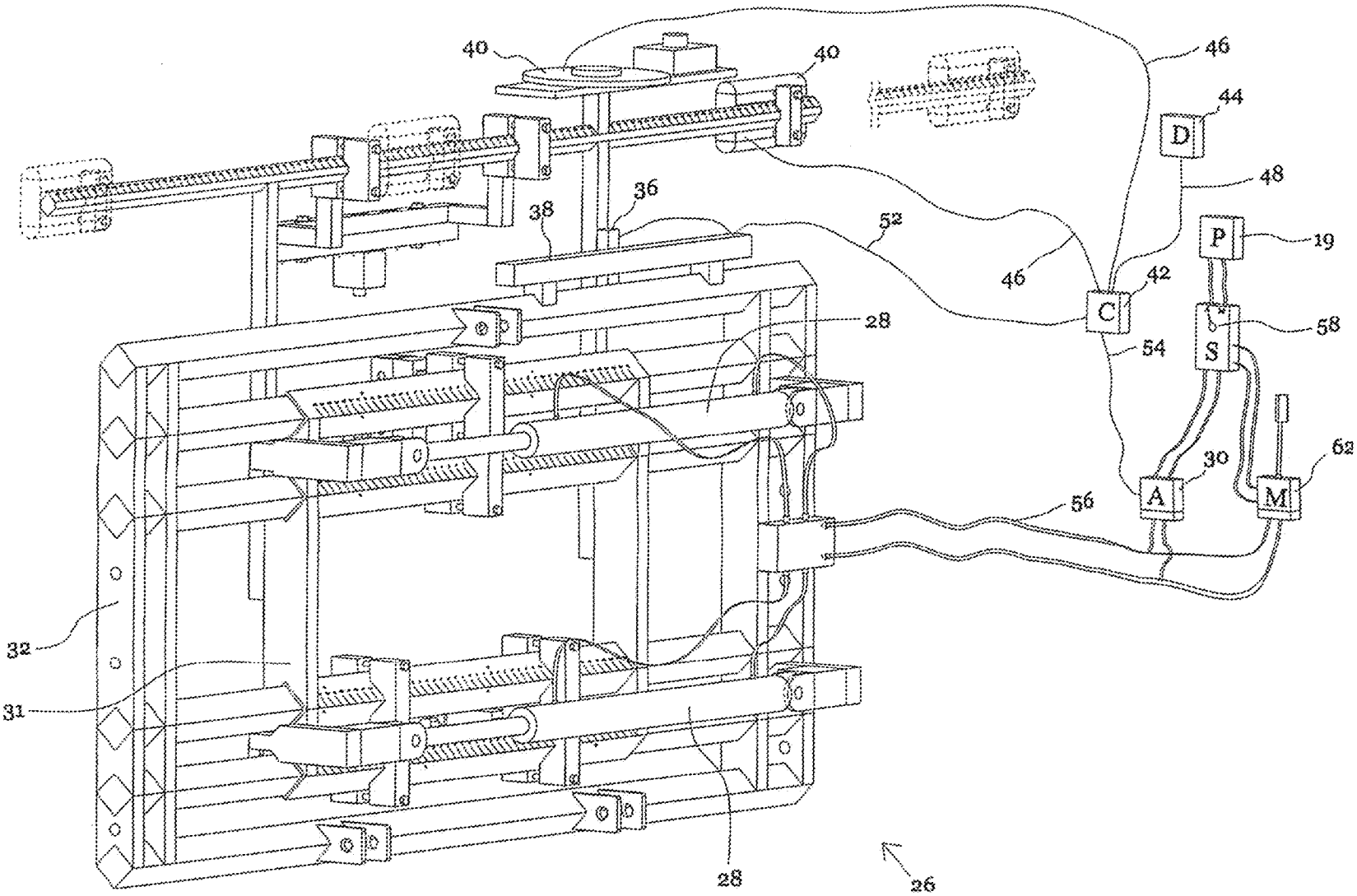
FIG. 6 is a perspective view of a side-shifting-implement connecting apparatus (Mollick U.S. patent application Ser. No. 15/480,914) showing some of the disclosed position monitoring system accessories displayed in a one line diagram as they reference the controller controlling the position of the side-shifting-implement.

FIG. 6 shows a drawing of side-shifting-implement attachment device 26 (Mollick U.S. patent application Ser. No. 15/480,914) depicting the tractor facing side of the apparatus. Many of the shown control devices are also comprised in the present invention as follows. Sensor 36 is shown as a smaller sensor mounted on the sliding-frame 31 and also travels across the area of the sensor bar 38. Sensor 38 is shown as a sensor bar mounted on the rigid frame 32, while both sensors measure each others position creating a relationship between the sensors and in turn representing the relationship position of an implement to the rigid-frame 32, rigid-frame 32 rigidly attached to the tractor 20 (see FIG. 2*b*) rear three-point hitch 22 (see FIG. 2*b*) rigid-frame 32 acting as an extension of the tractor 20, ultimately sensors 36 and 38 representing the position of the tractor 20 and an implement. Also shown is the controller 42, signal from controller to sensors 52, display with data entry 44, signal 48 from controller to display, driver control device 30, signal 54 to driver control device 30, signal or hydraulic fluid signal 56 from the driver control device 30 to the driver 28, signal 46 from controller 42 to receiver 40. Switch 58 to select manual or automatic driver operation, manual control device 62 for manual control of the driver. A power supply 19 provides power for the mobile machinery and the position monitoring system.

Figure 7:
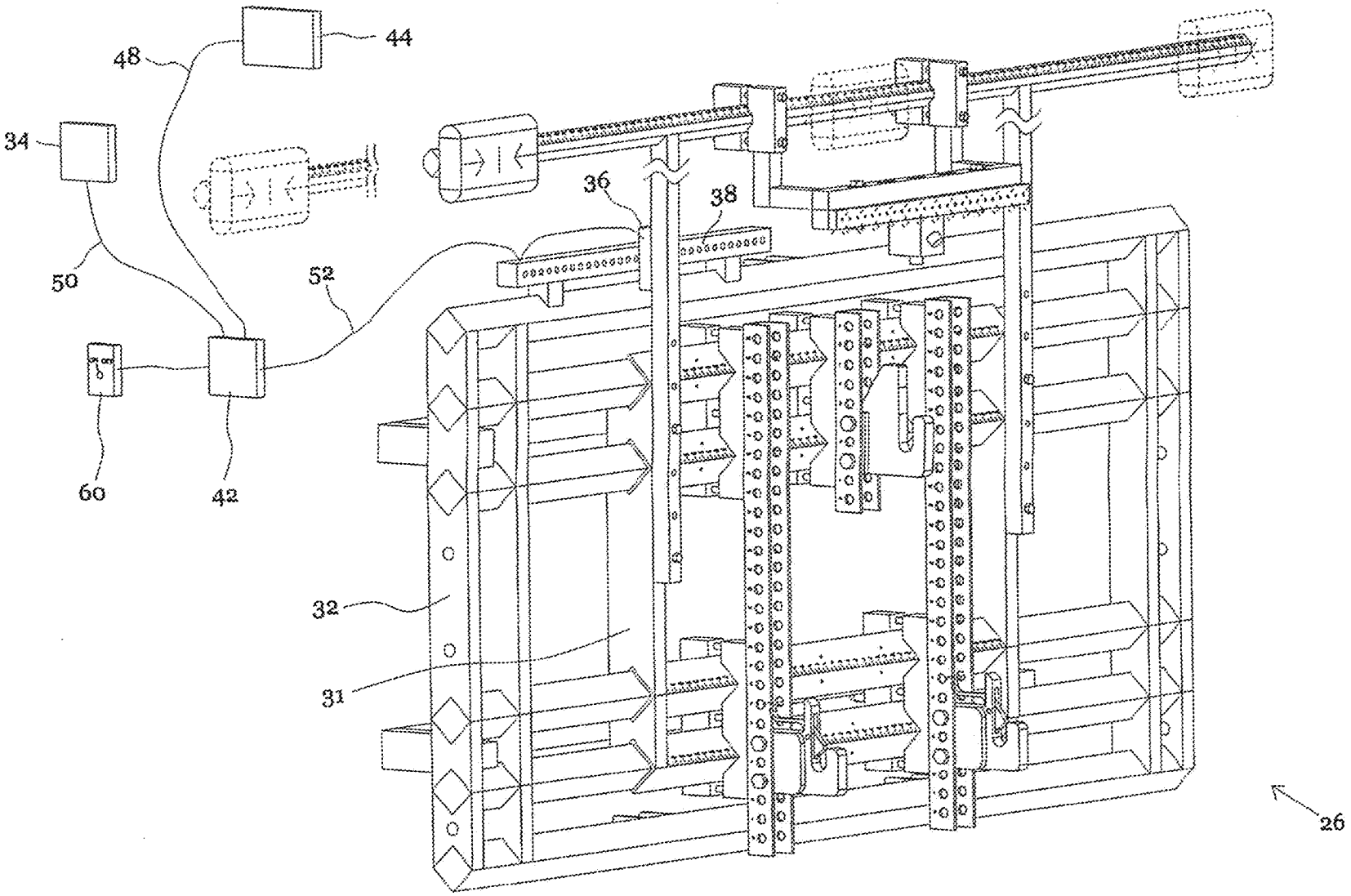
FIG. 7 is a perspective view of a side-shifting-implement connecting apparatus (Mollick U.S. patent application Ser. No. 15/480,914) showing some of the disclosed position monitoring system accessories displayed in a one line diagram as they reference the controller controlling the steering of the mobile machinery.

FIG. 7 shows a drawing of side-shifting-implement attachment device 26 (Mollick U.S. patent application Ser. No. 15/480,914) similar to FIG. 6 but instead depicting the implement facing side of the apparatus. Many of the shown control devices are also comprised in the present invention as follows. Sensor 36 is shown as a smaller sensor mounted on the sliding-frame 31 and also travels across the area of the sensor 38. Sensor 38 is shown as a sensor bar mounted on the rigid frame 32, while both sensors measure each others position creating a relationship between the sensors and in turn representing the relationship position of an implement to the rigid-frame 32, rigid-frame 32 rigidly attached to the tractor 20 (see FIG. 2*b*) rear three-point hitch 22 (see FIG. 2*b*) and rigid-frame 32 acting as an extension of the tractor 20, ultimately sensors 36 and 38 representing the position of the tractor 20 as compared to the attached implement. Also shown is the controller 42, signal from controller to sensors 52, display with data entry 44, signal 48 from controller to display, steering control device 34, signal 50 to steering control device 34, switch 60 to select manual or automatic steering operation using the steering wheel for manual steering control.

FIG. 8*a* is a flow chart depicting a hydraulic driver and related components suitable for use with the present invention. It utilizes the mobile machinery hydraulic pump 19, which is normally used for controlling the three-point hitch 22 bottom-link arms (see FIG. 1*a*) and utilizes a fluid reservoir. A guidance signal 12 is received by the receiver 40, which is connected to the driver controller 30. An antenna (not shown) is optionally provided to enhance the reception of the guidance signal to the signal receiver 40, but not required for a laser receiver 40 (see FIG. 6). The driver controller 30 controls the driver 28. If the hydraulic valve option switch 58 is in the automatic position, the automatic double action hydraulic valve 30 controls the driver 28. If the hydraulic valve option switch 58 is in the manual position, the automatic double action hydraulic valve 30 does not receive hydraulic fluid and is not operational, and thus the manual double action hydraulic valve 62 controls the driver at the tractor operator's initiation. Electrical power from the mobile machinery battery and generator 70 is used for powering components requiring electrical power.

FIG. 8*b* is a flow chart depicting a electric driver and related components suitable for use with the present invention. It utilizes a battery and generator 70, for powering components requiring electrical power. A guidance signal 12 is received by the receiver 40, which is connected to the driver controller 30. An antenna (not shown) is optionally provided to enhance the reception of the guidance signal to the signal receiver 40, but not required for a laser receiver 40 (see FIG. 6). The driver controller 30 controls the driver 28. If the electric option switch 58 is in the automatic position, the automatic electric switch 30 controls the driver 28. If the electric option switch 58 is in the manual position, the automatic electric switch 30 does not receive power and is not operational, and thus the manual electric switch 62 controls the driver at the tractor operator's initiation. Electrical power from the mobile machinery battery and generator 70 is used for powering components requiring electrical power.

For the purpose of the claims, the term "side-shifting-implement" designates the entire implement that moves laterally or the portion of an implement that moves laterally. An implement frame that does not move laterally but houses a portion of an implement that moves laterally, is considered a part of the mobile machinery. For example, a frame of rails attached to a motor-grader excavator that houses a side-shifting-blade is considered a part of the motor-grader and the side-shifting-blade is considered the side-shifting-implement. In another example is where an implement that mounts to a three point hitch of an agricultural tractor comprises a frame of rails that mounts to the three point hitch while also supporting the portion of the implement that side-shifts, this non-side-shifting frame of rails mounted to the three point hitch is considered a part of the mobile machinery and the portion of the implement that side-shifts is considered the "side-shifting-implement" in describing the claims.

What is claimed is:

1. A system for controlling the lateral traverse position of a front three-point hitch mounted side-shifting implement and a rear three-point hitch mounted side-shifting implement on a mobile machinery such as an agricultural tractor with an controllable automated steering device, while simultaneously controlling the position of the tractor relative to the positions of each of the two side-shifting implements, the system comprising:

a) a controller configured to use information from a position monitoring system to control and position the front mounted side-shifting-implement to track a predetermined path, and the controller configured to use information from the position monitoring system to control and position the rear mounted side-shifting-implement to track a predetermined path;

b) a rear rover data receiver mounted on the rear side-shifting-implement to enable the position monitoring system and the controller to control the position of the rear side-shifting-implement, and a front rover data receiver mounted on the front side-shifting-implement to enable the position monitoring system and the controller to control the position of the front side-shifting-implement;

c) a first rear sensor mounted on the tractor or mounted in a position representing the tractor position, a second rear sensor mounted on the rear side-shifting implement or mounted in a position representing the rear side-shifting implement position, and the first rear sensor and the second rear sensor sensing a relative position relationship with each other and relaying information to the controller;

d) a first front sensor mounted on the tractor or mounted in a position representing the tractor position, a second front sensor mounted on the front side-shifting implement or mounted in a position representing the front side-shifting implement position, and the first front sensor and the second front sensor sensing a relative position relationship with each other and relaying information to the controller; and e) the controller enabled to receive sensor relationship data from the first and the second rear sensors to determine and adjust the position of the tractor position relative to the rear side-shifting implement position, and the controller enabled to receive sensor relationship data from the first and the second front sensors to determine and adjust the position of the tractor position relative to the front side-shifting implement position.

2. The system of claim 1, wherein the position monitoring system is further configured to:

a) generate a map of the landscape and store the map in a data memory device for use by the controller;

b) generate predetermined paths of the front and the rear side-shifting implements and store the generated paths in the data memory device for use by the controller; and c) generate a predetermined path of the tractor in relation to the front and the rear side-shifting implement predetermined paths, and store the generated path in the data memory device for use by the controller.

3. The system of claim 1, wherein the controller can enable the desired position of the tractor relative to each side-shifting implement position to be predetermined.

4. The system of claim 1, wherein the controller can be changed to an manual operated guidance system allowing a tractor operator to manually steer the tractor with the steering wheel of the tractor.

5. The system of claim 1, wherein the controller communicates with a sensor relationship display screen mounted on the tractor and within view of the tractor operator, the sensor relationship display screen displaying the relationship between the tractor position and the front and the rear side-shifting implements positions.

6. The system of claim 5, wherein the controller can be changed to an assisted operated guidance system allowing a tractor operator to steer the tractor with the steering wheel of the tractor while viewing the sensor relationship display screen.

7. The system of claim 1, wherein the first and the second rover data receivers are laser data receivers, the position monitoring system and the controller communicates with the laser data receivers, and the position monitoring system comprises a laser emitting device.

8. The system of claim 1, wherein the first and the second rover data receivers are GPS data receivers communicating with the controller and GPS satellites.

9. The system of claim 2, wherein the first and the second rover data receivers are GPS data receivers communicating with the controller and GPS satellites.

10. The system of claim 1, wherein the position monitoring system comprises at least one base station receiver/transmitter capable of communicating data with the first and the second rover data receivers.

11. The system of claim 2, wherein the position monitoring system comprises at least one base station receiver/transmitter capable of communicating data with the first and the second rover data receivers.

12. The system of claim 1, comprising at least one rover data receiver attached to the tractor.

13. The system of claim 2, comprising at least one rover data receiver attached to the tractor.

14. The system of claim 1, where each side-shifting implement comprises a first frame and a second frame, each first frame is connected to the corresponding three-point hitch, and each second frame is a sliding frame mounted to the corresponding first frame.

15. The system of claim 14, where the side-shifting implement is an implement attachment apparatus for attaching an implement to the sliding second frame.

16. A system for controlling the lateral traverse position of a front three-point hitch mounted side-shifting implement and a rear three-point hitch mounted side-shifting implement on a mobile machinery such as an agricultural tractor, while simultaneously assisting the tractor operator of controlling the position of the tractor relative to the positions of each of the two side-shifting implements, the system comprising:

a) a controller configured to use information from a position monitoring system to control and position the front mounted side-shifting-implement to track a predetermined path, and the controller configured to use information from the position monitoring system to control and position the rear mounted side-shifting-implement to track a predetermined path;

b) a rear rover data receiver mounted on the rear side-shifting-implement to enable the position monitoring system and the controller to control the position of the rear side-shifting-implement, and a front rover data receiver mounted on the front side-shifting-implement to enable the position monitoring system and the controller to control the position of the front side-shifting-implement;

c) a first rear sensor mounted on the tractor or mounted in a position representing the tractor position, a second rear sensor mounted on the rear side-shifting implement or mounted in a position representing the rear side-shifting implement position, and the first rear sensor and the second rear sensor sensing a relative position relationship with each other and relaying information to the controller;

d) a first front sensor mounted on the tractor or mounted in a position representing the tractor position, a second front sensor mounted on the front side-shifting implement or mounted in a position representing the front side-shifting implement position, and the first front sensor and the second front sensor sensing a relative position relationship with each other and relaying information to the controller; and e) the controller enabled to receive sensor relationship data from the first and the second rear sensors to determine and display the data on a sensor display screen showing the position of the tractor position relative to the rear side-shifting implement position, and the controller enabled to receive sensor relationship data from the first and the second front sensors to determine and display the data on a sensor display screen showing the position of the tractor position relative to the front side-shifting implement position, therefore assisting the tractor operator in determining the required or preferred steering of the tractor.

17. The system of claim 16, wherein the first and the second rover data receivers are laser data receivers, the position monitoring system and the controller communicates with the laser data receivers, and the position monitoring system comprises a laser emitting device.

18. The system of claim 16, wherein the first and the second rover data receivers are GPS data receivers communicating with the controller and GPS satellites.

19. The system of claim 16, where each side-shifting implement comprises a first frame and a second frame, each first frame is connected to the corresponding three-point hitch, and each second frame is a sliding frame mounted to the corresponding first frame.

20. The system of claim 19, where the side-shifting implement is an implement attachment apparatus for attaching an implement to the sliding second frame.

* * * * *